United States Patent [19]

Kelley

[11] Patent Number: 4,786,231

[45] Date of Patent: Nov. 22, 1988

[54] NOISE ATTENUATING AND AIR STREAMLINING SPIRAL

[76] Inventor: Winfield L. Kelley, 1581 Brickell Ave., Miami, Fla. 33129

[21] Appl. No.: 936,391

[22] Filed: Dec. 1, 1986

[51] Int. Cl.[4] ..... F04D 29/66

[52] U.S. Cl. ..... 415/119; 415/197; 181/204

[58] Field of Search ..... 415/119, 9, 197; 181/225, 202, 204, 205, 277

[56] References Cited

U.S. PATENT DOCUMENTS

| | | | |
|---|---|---|---|
| 1,888,711 | 11/1932 | Bourne | 415/119 |
| 1,966,787 | 7/1934 | Buri | 415/142 |
| 2,554,602 | 5/1951 | Sutton | 415/182 |
| 3,602,602 | 8/1971 | Motta | 415/197 |
| 3,702,220 | 11/1972 | Medawar et al. | 415/119 |
| 3,762,497 | 10/1973 | Hatz et al. | 181/33 K |
| 3,947,148 | 3/1976 | Holt | 415/119 |
| 3,974,313 | 8/1976 | James | 415/9 |
| 4,049,074 | 9/1977 | Kazin | 181/286 |
| 4,240,250 | 12/1980 | Harris | 415/119 |
| 4,260,037 | 4/1981 | Eline | 181/204 |
| 4,425,080 | 1/1984 | Stanton et al. | 415/197 |
| 4,475,867 | 10/1984 | Smith | 415/119 |

FOREIGN PATENT DOCUMENTS

| | | | |
|---|---|---|---|
| 156035 | 8/1952 | Australia . | |
| 1403576 | 11/1968 | Fed. Rep. of Germany | 415/119 |
| 2307688 | 8/1974 | Fed. Rep. of Germany | 415/197 |
| 2393960 | 2/1979 | France | 415/119 |
| 1177550 | 9/1985 | U.S.S.R. | 415/119 |
| 1005139 | 9/1965 | United Kingdom . | |
| 1196176 | 6/1970 | United Kingdom | 415/119 |

*Primary Examiner*—Robert E. Garrett
*Assistant Examiner*—John T. Kwon
*Attorney, Agent, or Firm*—Stevens, Davis, Miller & Mosher

[57] ABSTRACT

A fan assembly which has an air inlet that combines the function of absorbing fan noise and the function of streamlining air intake. A continuous strip of sound absorbing material is mounted on a perforated support and is wrapped in an overlapping manner which, when placed with the fan, dampens fan noises, as well as allows acceleration and uniformity of distribution of incoming airflow.

8 Claims, 1 Drawing Sheet

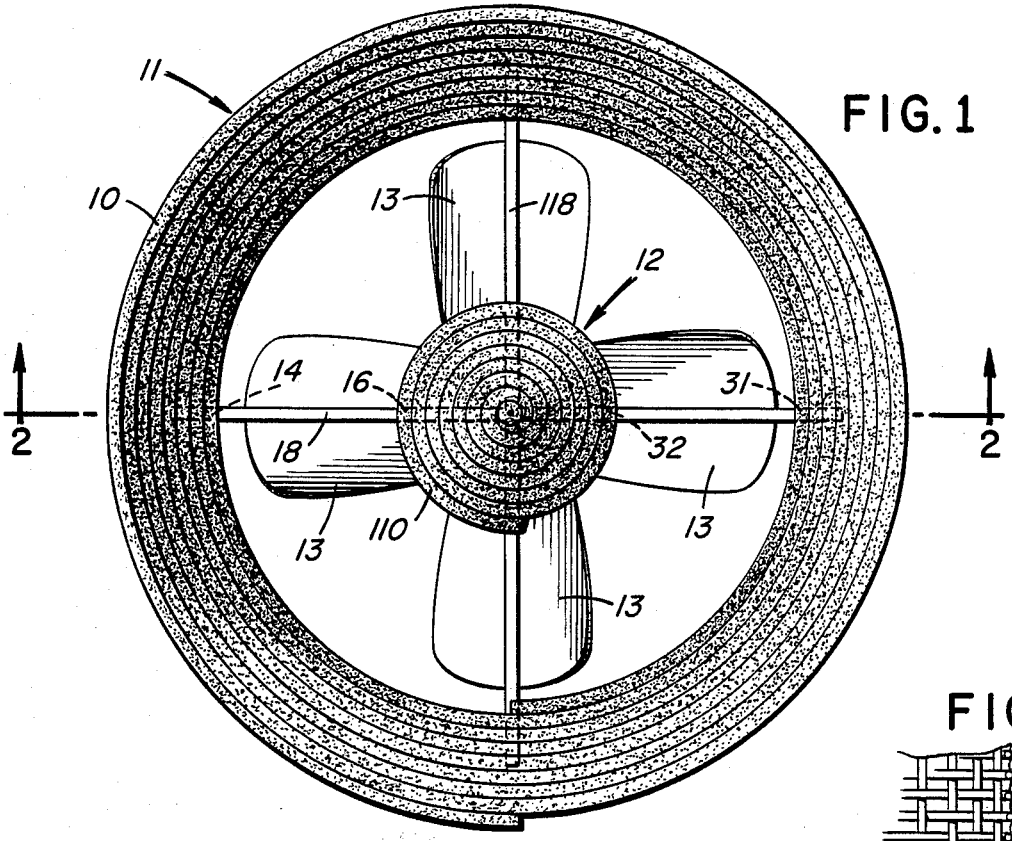
FIG. 1
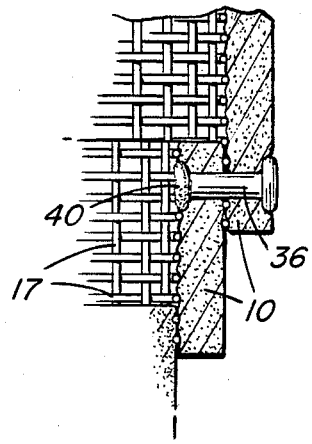
FIG. 3
FIG. 2
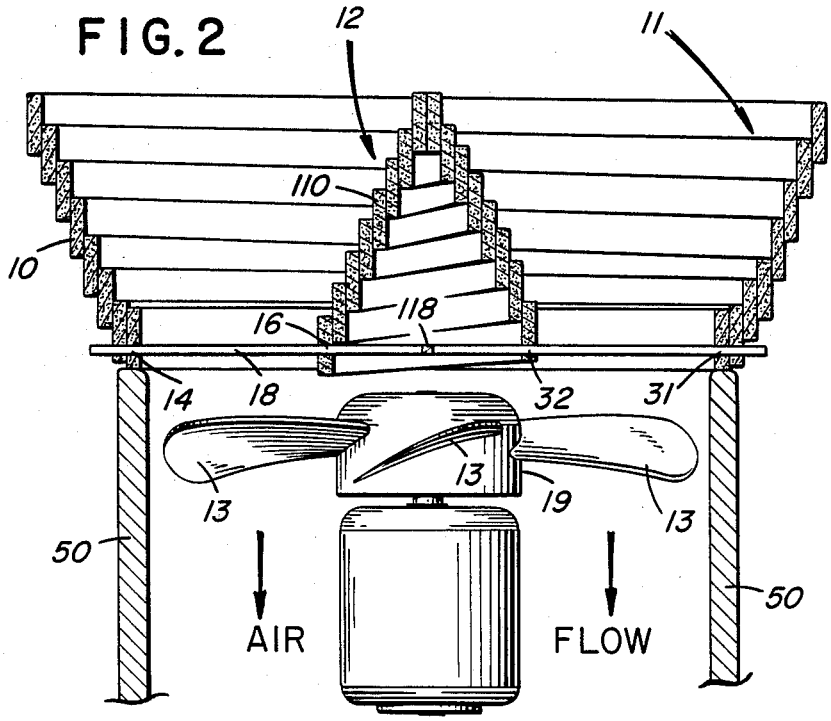
FIG. 4
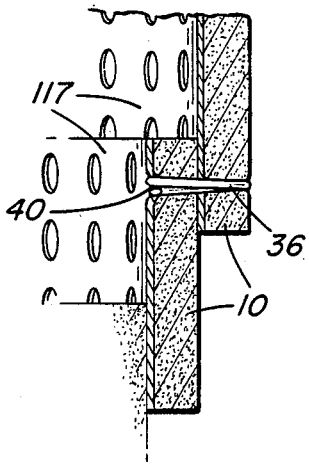

NOISE ATTENUATING AND AIR STREAMLINING SPIRAL

BACKGROUND OF THE INVENTION

1. Field of the Invention

This invention relates to air inlet assemblies for fan units which utilize sound absorbing material to reduce fan noise, as well as evenly distribute the flow of air to the moving fan blades.

2. Background Art

The use of sound absorbing material has long been recognized as an effective means for reducing noise created by operating fans. Sound absorbing material has been placed through slots in duct walls, thus openly exposing the material to the fan blades. U.S. Pat. No. 3,947,148 embodies an installation technique where the material is projected through openings in the duct walls so that a minimum distance exists between the tips of the fan blades and the sound absorbing material. However, the material is not contained and conserved within the structure. Sound absorbing material also has been enclosed in structures that expose the sound absorbing material to the "noise areas" of the fan. For instance, U.S. Pat. No. 3,762,497 describes the use of "sieve-like" walls along the air inlet area to increase the sound dampening effect of the sound absorbing material enclosed therein. This utilization is effective, since the holes in the wall directly expose the material to the "noise creating" area. U.S. Pat. No. 3,762,497 further describes this utilization as helpful in reducing the amount of space taken up by the sound absorbing material, as well as in making for an economically efficient sound absorbing device.

It is an object of this present invention to provide an air inlet assembly, further reducing the amount of space taken up by the sound absorbing material.

Another object of the present invention is to provide a very compact and contained air inlet assembly.

Still another object of the present invention is to provide an air inlet assembly utilizing readily obtainable strips of support structure and sound absorbing material.

It is a further object of this invention to provide an air inlet assembly which streamlines the incoming air and, at the same time, dampens fan noise.

BRIEF SUMMARY OF THE INVENTION

The invention provides for an air inlet assembly for a fan unit comprising strips of sound absorbing material reinforced by perforated support strips. Preferably, these strips of sound absorbing material and perforated supports are wound in a helical overlapping manner to form a frusto-conical configuration, as well as a conical configuration. The conical configuration is placed within the frusto-conical structure so as to further the streamlining of the intake airflow. The intake is supported by two transverse members passing through the conical and frustoconical structures.

By using the sound absorbing material in the intake element of a fan unit, the fan noise is reduced. However, by taking strips of sound absorbing material and forming the streamlining element of the air intake, this device not only reduces noise, but reduces the amount of space taken up by the inlet.

BRIEF DESCRIPTION OF THE DRAWINGS

Other details and features of the invention will stand out from the description given below by way of non-limiting example and with reference to the accompanying drawings, in which:

FIG. 1 is a plan view of the air inlet assembly of the present invention;

FIG. 2 is a sectional view of the air inlet assembly of FIG. 1, taken along lines 2—2 of FIG. 1;

FIG. 3 is an enlargement of a portion of FIG. 1, showing the fastening of overlapping portions of the strips utilizing wire mesh; and FIG. 4 is an enlargement of a portion of FIG. 1, showing the fastening of overlapping portions of the strip utilizing perforated metal.

DESCRIPTION OF THE PREFERRED EMBODIMENT

Referring to FIG. 1, there is shown an air inlet assembly formed by two helically overlapping strips 10, 110 of supported sound absorbing material. Strip 10 of reinforced material is formed into a frusto-conical configuration 11, and strip 110 is formed into a conical configuration 12. As shown in FIGS. 1 and 2, configurations 11 and 12 are supported by transverse support members 18 and 118. Member 18 passes through the bottom of the frusto-conical configuration 11 at points 14 and 31, and the bottom of conical configuration 12 at points 16 and 32. The other support member 118 passes through the bottom of configurations 11 and 12 at right angles to member 18. These supports are used to position conical configuration 12 over an hub 19, as well as stabilize the frusto-conical configuration 11, so that it can be easily attached onto the edges of the fan housing 50. As shown in FIG. 1, the supports 18 and 118 reveal fan blades 13, exposed to the streamlined intake.

As further shown in FIG. 2, the helically wound configurations 11 and 12 are formed by overlapping the strip 10 or 110 on itself as it is wound to form the respective configurations 11 and 12. As for configuration 11, the reinforced strip 10 is wound one time to match the circumference of the fan housing, and then with each successive winding of the reinforced strip, it overlaps itself on its outer side, as shown in FIG. 3. As for configuration 12, the strip is wound one time to coincide with the apex of the cone, and then with each successive winding the strip overlaps itself until the configuration 12 is formed.

The strip of sound absorbing material 10 is preferably laminated fiberglass, reinforced by a support strip, which may be wire mesh 17 or perforated metal 117. In FIG. 3, the support strip 17 is expanded wire mesh. In FIG. 4, the support strip 117 is perforated metal. The width of the reinforcement strip coincides with the width of the fiberglass, which can come in various widths, according to the diameter of the fan being used. For example, a reinforcement strip of thickness x width of $\frac{1}{2}'' \times 3''$ may be used to support strip 10 of similar dimensions, to be used with a fan of diameters ranging from 24" to 48". Likewise, a $\frac{1}{2}'' \times 6''$ strip of reinforced sound absorbing material could be used to form the assembly for fans with diameters ranging from 48" to 96". The width of the strip may be increased to decrease the number of laps needed to make assembly.

As further shown in FIGS. 3 and 4, the overlapping strips for both configurations 11 and 12 are fastened to each other by a fastener 36. As shown in FIG. 4, the fastening means 36 attaches each succeeding lap to the previous lap by penetrating the succeeding reinforced strip and continuing through the preceding reinforced strip. The fastener's anchoring means 40 extends through a perforation of the reinforced strip and anchors itself on the surface of the support so that it compresses the overlap together. The fastening means can be that known to the art, such as wire ties, rivets, and staples. The preceding technique would also be used for the conical configuration 12.

I claim:

1. An air inlet assembly for a fan unit containing a fan and means to rotate said fan, comprising:

support members attachable at uniformly spaced locations to said fan units;

a first perforated support strip;

a first strip of sound absorbing material mounted on said perforated support strip, said first perforated support strip and first sound absorbing material being bound in a helical overlapping manner to form a frusto-conical configuration, said support members passing transversely through said frusto-conical configuration adjacent the edge of smaller transverse dimensions;

a second perforated strip; and a second strip of sound absorbing material mounted on said second perforated support strip, said second perforated support strip and second sound absorbing material strip being wound in a helical overlapping configuration to form a cone, said cone configuration being positioned within the frustoconical configuration and shielding in front from inlet air said means to rotate said fan, said support members passing transversely through said conical configuration adjacent the edge of the base, and said support members crossing each other.

2. The air inlet assembly of claim 1, including fasteners fastening together overlapped portions of said first perforated support strip and first strip of sound absorbing material.

3. The air inlet assembly of claim 1, including fasteners fastening together overlapped portions of said first perforated strip and mounted sound absorbing material and said second perforated strip and mounted sound absorbing material.

4. The air inlet assembly of claim 1, wherein said first perforated support strip is wire mesh.

5. The air inlet assembly of claim 1, wherein said first perforated support strip is perforated metal.

6. The air inlet assembly of claim 1, wherein said first and second perforated support strips are wire mesh.

7. The air inlet assembly of claim 1, wherein said first and second perforated support strips are perforated metal.

8. The air inlet assembly of claim 1, wherein said support members are metal bars.

* * * * *